US006777888B2

(12) United States Patent
Kondo

(10) Patent No.: US 6,777,888 B2
(45) Date of Patent: Aug. 17, 2004

(54) DRIVE CIRCUIT TO BE USED IN ACTIVE MATRIX TYPE LIGHT-EMITTING ELEMENT ARRAY

(75) Inventor: Shigeki Kondo, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 20 days.

(21) Appl. No.: 10/247,303

(22) Filed: Sep. 20, 2002

(65) Prior Publication Data

US 2003/0016190 A1 Jan. 23, 2003

Related U.S. Application Data

(63) Continuation of application No. PCT/JP02/02470, filed on Mar. 15, 2002.

(30) Foreign Application Priority Data

Mar. 21, 2001 (JP) ..... 2001-080505

(51) Int. Cl.[7] ..... G09G 3/10

(52) U.S. Cl. ..... 315/169.3; 315/169.1; 345/76; 345/92

(58) Field of Search ..... 315/169.1, 169.3, 315/169.4; 345/76–78, 80, 82, 84, 92, 55

(56) References Cited

U.S. PATENT DOCUMENTS

| | | | | |
|---|---|---|---|---|
| 6,229,506 | B1 * | 5/2001 | Dawson et al. | 345/82 |
| 6,373,455 | B1 * | 4/2002 | Kuribayashi et al. | 315/169.3 |
| 6,501,466 | B1 * | 12/2002 | Yamagishi et al. | 345/82 |
| 6,525,704 | B1 * | 2/2003 | Kondo et al. | 315/169.3 |
| 6,580,408 | B1 * | 6/2003 | Bae et al. | 345/76 |

FOREIGN PATENT DOCUMENTS

| | | |
|---|---|---|
| EP | 1 130 565 A1 | 9/2001 |
| JP | 59-154808 | 9/1984 |
| JP | 03-139908 | 6/1991 |
| JP | 09-244590 | 9/1997 |
| JP | 2000-347621 | 12/2000 |
| JP | 2001-060076 | 3/2001 |
| WO | WO 98/48403 | 10/1998 |
| WO | WO 01/06484 A1 | 1/2001 |

OTHER PUBLICATIONS

"Design of a Prototype Active Matrix CdSe TFT Addressed EL Display," J. Vanfleteren, et al., Laboratory of Electronics, Ghent State University, Belgium, pp. 216–219, 1990.

"Low–Temperature Poly–Si TFT Display using Light–Emitting–Polymer," M. Kimura, et al., AM–LCD 2000, AM3–1, pp. 245–248, 2000.

"36.1: 6–Bit Digital VGA OLED," M. Mizukami, et al., SID 2000 Digest, 2000, pp. 912–915.

* cited by examiner

*Primary Examiner*—Don Wong
*Assistant Examiner*—Ephrem Alemu
(74) *Attorney, Agent, or Firm*—Fitzpatrick, Cella, Harper & Scinto

(57) ABSTRACT

In a drive circuit to be used for a light-emitting panel formed by a light-emitting element array having a matrix type configuration, wherein a plurality of thin film transistors are arranged for each pixel of the light-emitting element array, a circuit for canceling the offset voltage of a drive transistor is provided by arranging a memory capacitance at the input side of the light-emitting element to instantly accumulate the offset voltage of the drive transistor so as to offset the phenomenon of the voltage fall that is equal to the offset voltage when an image signal s applied at the next timing. With this arrangement, variances in the characteristic of the drive transistors can be cancelled to lessen the variances in the brightness of the light-emitting elements and improve the high speed response of the light-emitting elements.

9 Claims, 6 Drawing Sheets

DRIVE CIRCUIT TO BE USED IN ACTIVE MATRIX TYPE LIGHT-EMITTING ELEMENT ARRAY

This application is a continuation of International Application No. PCT/JP02/02470, filed Mar. 15, 2002, which claims the benefit of Japanese Patent Application No. 080505/2001, filed Mar. 21, 2001.

BACKGROUND OF THE INVENTION

1. Field of the Invention

This invention relates to a drive circuit to be used in an active matrix type light-emitting element array for driving and controlling an array of emission type elements such as organic and inorganic electroluminescent (to be referred to as "EL" hereinafter") elements or light-emitting diodes (to be referred to as "LED" hereinafter) and also to an active matrix type display panel realized by using such a drive circuit.

2. Related Background Art

Display devices adapted to display characters and images by means of a dot matrix formed by arranging light-emitting elements such as organic or inorganic EL elements or LEDs are currently popularly being used in television sets, mobile terminals and other applications.

Particularly, display devices comprising emission type elements are attracting attention because, unlike display devices utilizing liquid crystal, they have a number of advantages including that they do not require a backlight for illumination and provide a wide view angle. Above all, display devices referred to as active matrix type devices that are realized by combining transistors and light-emitting elements and adapted to be operated in a drive mode referred to as static drive have been drawing attention because they provide remarkable advantages including high brightness, high contrast and high definition if compared with display devices that operate on a time division drive basis in a simple matrix drove mode.

FIG. 8 of the accompanying drawings is quoted from Preliminary Papers "Eurodisplay '90" for Autumn Convention 1990, pp. 216–219, published by Society for Information Display. It illustrates a known display circuit of the type under consideration. More specifically, it shows a light-emitting element drive circuit of an active matrix type display device comprising EL elements as light-emitting elements.

As seen from FIG. 8, when the scan line 36 that is connected to the gate of transistor 35 of the drive circuit is selected and activated, the transistor 35 becomes ON and a signal is written in capacitor 38 from the data line 37 connected to the transistor 35. The capacitor 38 determines the voltage between the gate and the source of transistor 41. When the scan line 36 is no longer selected and the transistor 35 becomes OFF, the voltage between the opposite ends of the capacitor 38 is held unchanged until the scan line 36 is selected in the next cycle and the transistor 41 is held ON during that period.

As the transistor 41 becomes ON, an electric current flows from power supply electrode 39 to common electrode 42 by way of EL element 40 and the drain/source of the transistor 41 to drive the organic EL element 40 to emit light.

Generally speaking, for the display terminal of a computer, the monitor screen of a personal computer or the display screen of a television set to display a moving image, it is desirable that each pixel can change the brightness so as to display gradation. As far as organic EL elements are concerned, known systems that have hitherto been used to provide displayed images with gradation include the analog gradation system, the area gradation system and the time gradation system.

The analog gradation system is designed to control the brightness of emitted light of an organic EL element as a function of the quantity of the electric current flowing through the organic EL element. If a thin film transistor (to be referred to as "TFT" hereinafter) is used as switching element for supplying the electric current, a control signal is applied as gate voltage according to a video signal so as to control the conductance of the switching element by using a rising region (to be referred to as "saturated region" here for the sake of convenience) of the source current characteristic (Vg-Is characteristic) relative to the gate voltage.

Then, it is necessary to make the gamma ($\gamma$) characteristic of the video signal change according to the brightness—voltage characteristic of the organic EL element.

Currently available TFTs include those of the amorphous silicon (a-Si) type and those of the polysilicon (polycrystalline silicon) type (p-Si), of which polycrystalline silicon TFTs are in the mainstream because they show a high mobility and can be downsized in addition to that the process of manufacturing polycrystalline silicon TFTs can be conducted at low temperature due to the recent advancement of laser processing technology. However, generally, polycrystalline silicon TFTs are apt to be affected by the crystal grain boundaries thereof and their electric characteristics can vary remarkably particularly in the saturated region. In other words, even if a uniform video signal voltage is applied to the pixels of the display device, an uneven image can be displayed.

Furthermore, most TFTs are currently being used as switching elements. More specifically, they are adapted to be used in a linearly operating region where the drain current changes proportionally relative to the source voltage when a gate voltage that is considerably higher than the threshold voltage of the transistor is applied so that they are not significantly affected by the varying electric characteristics in the saturated region. However, if polysilicon TFTs are operated in the saturated region in order to adopt the analog gradation system, the display performance of the display device can become unstable as the operation of the TFTs are affected by the varying electric characteristics.

When, for instance, the organic EL element 40 is driven by the TFT circuit to display analog gradation in FIG. 8, the voltage applied between the gate and the source of the transistor 41 is slightly higher than the threshold voltage (Vth) of the transistor. FIG. 9 is a graph illustrating the Vg-Is characteristics of different transistors. The transistors are adapted to utilize the part of the characteristic curve where the source current rises as the gate voltage increases (or the saturated region). However, if the gate voltage—source current characteristic (Vg-Is characteristic) varies as shown in FIG. 9 (or the threshold voltage Vth of the transistor varies), the electric current that flows through the transistor 41 can also vary as indicated by IA (intersection of the curve of a solid line and VA) and IB (intersection of the curve of a broken line and VA) even if a constant gate voltage VA is applied to the gate electrode of the transistor 41 in FIG. 8. Additionally, the brightness of light emitted when a constant voltage is applied may vary depending on the manufacturing process that can involve problems such as film thickness distribution of an organic layer. Such variances are particularly significant when brightness is related to providing gradation. Referring to FIG. 8 again, the part surrounded by dotted lines 43 indicates a region that is apt to produce such variances. Then, organic EL elements 40 that are supposed to show a same level of brightness when a same voltage is applied can actually show different levels of brightness. Such variances in brightness can degrade the quality of the displayed image.

On the other hand, the area gradation system is proposed in AM-LCD2000, AM3-1. It is a system of dividing each pixel into a plurality of sub-pixels so that each sub-pixel can be turned ON and OFF and gradation may be defined by the total area of the pixels that are ON.

With this mode of utilizing organic EL elements, TFTs are used as switching elements so that a gate voltage that is much higher than the threshold voltage is applied to exploit a region of the characteristic curve where the drain voltage is proportional to the source voltage (or the linear region) in order to avoid variances in the TFT characteristic and stabilize the light-emitting characteristic. However, this gradation mode can provide only digital gradation that depends on the dividing manner for the display area and the number of sub-pixels has to be increased by reducing the area of each sub-pixel when raising the number of gradations. Even if transistors are downsized by using polycrystalline silicon TFTs, the area of the transistor arranged in each pixel comes to occupy the corresponding light-emitting area to a large extent to consequently reduce the aperture ratio of the pixel so that by turn the brightness of the entire display panel is inevitably reduced. In other words, the gradation is a tradeoff for the aperture ratio and therefore it is difficult to improve the gradation. Additionally, the density of the drive current flowing through an organic EL element may have to be raised to achieve a desired level of brightness to consequently raise the drive voltage of the element and reduce the service life of the element.

Finally, the time gradation system is a system of controlling the gradation by way of the ON time period of each organic EL element as reported in SID 2000 DIGEST 36.1 (pp. 912–915). However, the TFTs of the display panel have to be driven to operate in a linear region as in the case of the area gradation system in order to minimize the variances in the TFT characteristic so that the problem of a high power supply voltage to be applied to the drive circuit and a high overall power consumption rate remains unsolved.

Additionally, the time gradation system is a complicated system for driving a display device. Currently, for ordinary picture signals transmitted to display devices, brightness signals of three primary colors of RGB are output in the form of analog signals. In the case of video signals, signals are produced by decoding composite signals or Y/C signals into RGB brightness signals. The analog signals need to be changed into PWM signals that are time amplitude signals. For this purpose, as shown in FIG. 10, an AD converter, an image memory, a PWM signal converter circuit and an MPU for controlling them are required.

Furthermore, with the time gradation system, a pulse voltage has to be applied for a very short period of time to each element that is provided with matrix wiring. Therefore, it is necessary to reduce the electric resistance of the matrix wiring system in the display panel. Then, the display panel has to be so designed as to use a low resistance material for the wires and raise the thickness of the wires in order to reduce the electric resistance thereof.

While the analog gradation system requires only a signal amplifying circuit for changing the signal level of RGB analog signals to the brightness signal level that matches the display elements on the display panel as shown in FIG. 11, the time gradation system requires a complex drive system as described above, which by turn raises the power consumption level and the cost of manufacturing the elements. Thus, the time gradation system is accompanied by a number of problems including not only those relating to the performance of the display device but also those relating to the drive system.

However, if the analog gradation system is adopted, the individual transistors can show respective threshold voltages (Vth) that vary from transistor to transistor to a large extent, as mentioned above. Then the output current can also show variances to consequently give rise to variances in the brightness of emitted light.

Variances of the threshold voltage will be briefly discussed below.

As shown in FIG. 8, a TFT for driving an EL element operates as part of a source follower circuit from the circuit point of view. In the source follower circuit, the drain of the TFT is connected to power source Vdd and the gate operates as input terminal, while the source operates as output terminal. Thus, the EL element is arranged between the source of the TFT and the Vss (GND) and an electric current flows through it. If the source terminal voltage is Vout and the gate input voltage is Vin, $$Vout = Vin - Vos,$$

where Vos is the offset voltage generated between the gate and the source.

Generally, if the electric current that flows to the source terminal is Iout, Vos is expressed by $$Vos = Vth + \sqrt{(Iout/\beta)},$$

where $$\beta = (1/2) \times \mu \times Cox \times (W/L),$$

where $\mu$ represents the mobility and Cox, W and L respectively represent the gate oxide film capacitance, the gate width and the gate length of the TFT.

As may be clear from the above description, in a source follower circuit comprising TFTs, each individual TFT has its own offset voltage Vos that is specific to it and causes variances in the threshold voltage Vth of transistor. Therefore, it is desired to eliminate the influence of offset voltage and provide a stable output characteristic curve from the viewpoint of driving organic EL elements by means of TFTs with the analog system.

SUMMARY OF THE INVENTION

In view of the above identified circumstances, it is therefore the object of the present invention to provide a drive circuit of an active matrix type light-emitting element array that can cancel variances in the signal to be applied to light-emitting elements so as to improve the response speed of the light-emitting element array when a TFT realized using polycrystalline silicon and showing a characteristic that is subject to variance is employed and also provide an active matrix type display panel using such a drive circuit.

In an aspect of the invention, the above object is achieved by providing a drive circuit to be used in an active matrix type light-emitting element array comprising scan lines and signal lines arranged on a substrate to form a matrix and unit pixels formed near the respective crossings of the scan lines and the signal lines, each unit pixel including a light-emitting element and a plurality of thin film transistors each having a source electrode, a gate electrode and a drain electrode, the drive circuit comprising:

a first circuit section including a first thin film transistor (M1) having a gate electrode connected to a scan line, a source electrode connected to a signal line and a drain electrode;

a second circuit section including a light-emitting element having an electrode connected to a first power source and a second thin film transistor (M2) having a gate electrode, a source electrode connected to a second power source and a drain electrode connected to another electrode of the light-emitting element, hence the light-emitting element being connected in series to the second thin film transistor; and a third circuit section including a third thin film transistor (M3) having a source electrode connected to a reference power source and a drain electrode connected to the gate electrode of the second thin film transistor;

the drain electrode of the first thin film transistor being connected to the gate electrode of the second thin film transistor by way of a memory capacitance (C1);

the drain electrodes of the first and second thin film transistors being commonly connected.

Typically, the voltage of the reference power source is higher than the threshold voltage of the second thin film transistor and lower than the light emission threshold voltage of the light-emitting element.

A drive circuit having a configuration as defined above may further comprise a fourth circuit section including a fourth thin film transistor having a source electrode connected to a reset voltage and a drain electrode connected commonly to the input terminal of the light-emitting element.

This arrangement provides a functional feature of forcibly terminating the light-emitting state of the light-emitting element by turning on the fourth transistor particularly in a field period.

In another aspect of the invention, there is provided an active matrix type display device comprising a plurality of pixel sections arranged in the form of a matrix, the pixel sections respectively having the above drive circuits and the light-emitting elements.

DESCRIPTION OF THE PREFERRED EMBODIMENTS

Now, the present invention will be described by referring to the accompanying drawings that illustrate preferred embodiments of the invention, although the present invention is by no means limited to the embodiments.

Embodiment 1

Figure 1:
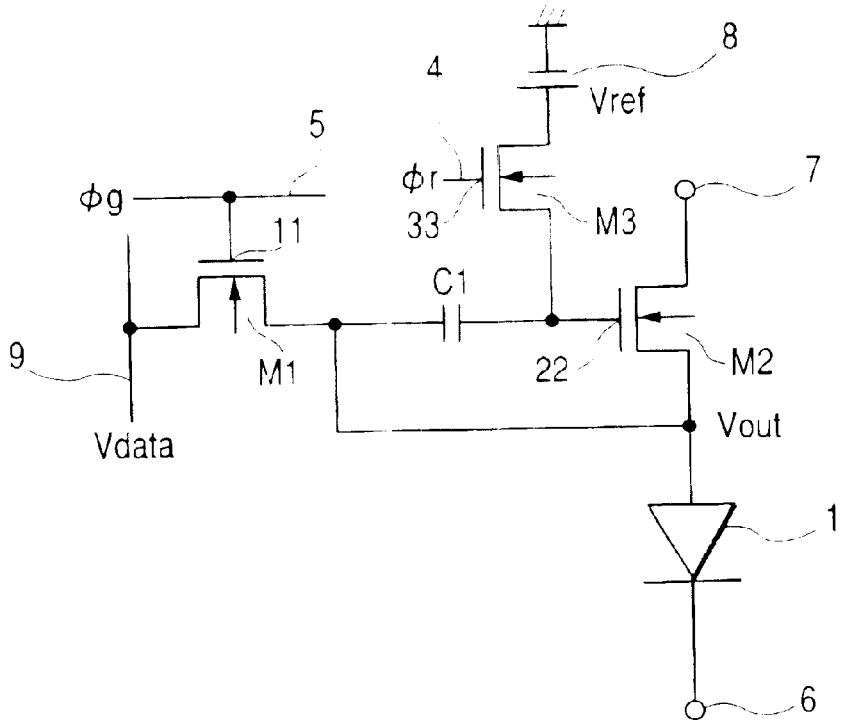
FIG. 1 is a circuit diagram of the first embodiment of drive circuit to be used in an active matrix type light-emitting element, the first embodiment comprising a first circuit section including a first TFT (Ml) and a memory capacitance, a second circuit section including a second TFT (M2) and a light-emitting element and a third circuit section including a third TFT (M3) and a reference power source.
Figure 2:
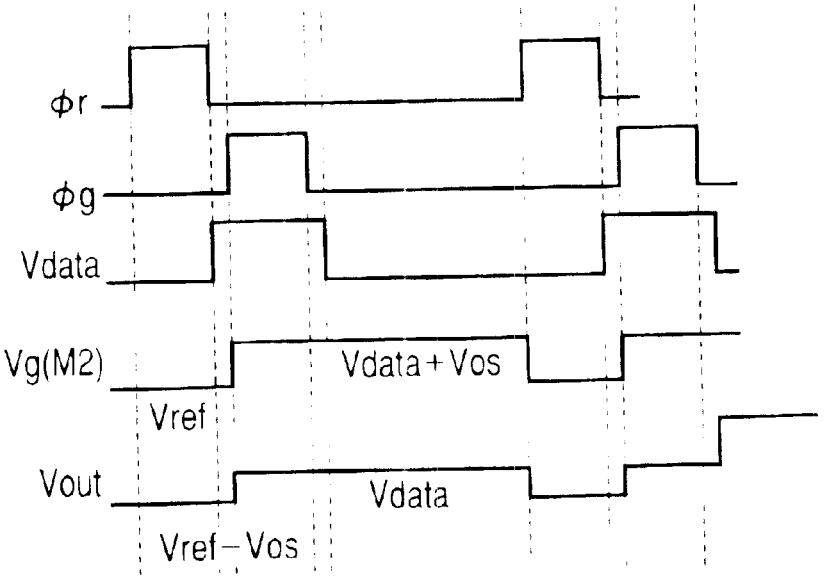
FIG. 2 is a timing chart to be used for the first embodiment of drive circuit.

FIG. 1 is a circuit diagram of the first embodiment of drive circuit to be used in an active matrix type light-emitting element array and FIG. 2 is a drive timing chart to be used for the first embodiment of drive circuit. In FIGS. 1 and 2, M1, M2 and M3 denote respective Nch-TFTs and C1 denotes a memory capacitance, whereas $\phi r$ and $\phi g$ respectively denote a control pulse signal and a scan line signal and Vdata denotes a picture signal for driving the light-emitting element.

This embodiment of drive circuit is so designed as to be used in an active matrix type light-emitting element array comprising scan lines 5 and signal lines 9 arranged to form a matrix and unit pixels arranged near the respective crossings of the scan lines and the signal lines, each unit pixel including a plurality of TFTs (M1, M2, M3) and a light-emitting element 1.

This embodiment employs an organic EL element for the light-emitting element 1. One of the electrodes of the organic EL element is connected to first power source 6. The drain electrode of the first TFT (M1) is connected to one of the electrodes of memory capacitance C1 and at the same time to the drain electrode of the second TFT (M2) and the other electrode of the light-emitting element 1.

The second TFT (M2) has its source electrode connected to second power source 7 and its gate electrode 22 connected to the other electrode of the memory capacitance C1 and also to the drain electrode of the third TFT (M3). The third TFT (M3) has its source electrode connected to reference power source 8 and its gate electrode 33 connected to control signal line 4. The first TFT (M1) has its source electrode connected to picture data signal line 9 and its gate electrode 11 connected to the scan line 5.

Referring now to FIG. 2 illustrating a timing chart to be used for the first embodiment of drive circuit, the TFT (M3) is turned on and reference voltage Vref is applied to the gate electrode 22 of the TFT (M2) constituting a source follower circuit at the first timing. Since the reference voltage Vref is defined to be higher than the threshold voltage of the TFT (M2), the latter is turned on at this timing.

As a result, the output Vout of the source follower, which is applied to one of the electrodes of the light-emitting element 1, produces a voltage showing the value obtained by subtracting the offset voltage Vos of the TFT (M2) from the reference voltage Vref or $$Vout=Vref-Vos.$$

Note that the potential fall due to the TFT (M3) is disregarded here. At this time, a voltage equal to the difference between Vref and Vout is produced between the opposite ends of the memory capacitance C1.

$$Vref-V\text{out}=Vos.$$

From the viewpoint of the reference voltage Vref, if the value of Vout is not greater than the light emission threshold value of the light-emitting element, the latter does not emit light at this time.

At the next timing when the TFT (M3) is turned off and the TFT (M1) is turned on, the picture data signal Vdata is transferred to one of the electrodes of the memory capacitance C1. As a result, since one of the terminals of the memory capacitance C1 that is connected to the gate electrode of the TFT (M2) is electrically floating, a voltage equal to the sum of Vdata and the voltage Vos that was induced in the preceding step, or Vdata+Vos, is produced for the gate voltage Vg (M2) of the TFT (M2). At this time, the output voltage of the source follower is produced at one of the electrodes of the light-emitting element 1.

$$V\text{out}=V\text{data}+Vos-Vos=V\text{data}$$

Thus, the offset voltage of the TFT (M2) is not applied to the light-emitting element 1. In other words, the offset voltage is cancelled.

As pointed out above, the reference voltage Vref of this embodiment is so defined as to make Vref−Vos not greater than the light emission threshold value of the light-emitting element. When the reference voltage is defined as such, it provides the following effect.

Currently, massive development efforts are being paid for raising the light-emitting efficiency of light-emitting elements from the viewpoint of achieving a long service life and reducing the power consumption rate. However, the drive current that drives an organic EL element with highest efficiency is about 2 to 3 μA for a pixel size of 100 μm×100 μm at present. The junction capacitance of an organic EL element is about 25 nF/cm$^2$ and therefore a pixel of 100 μm×100 μm shows a capacitance of about 2.5 pF.

Thus, for producing an 8-bit gradation by the analog gradation system, the minimum electric current will be $$2 \text{ to } 3\ \mu A/2^8=8 \text{ to } 12 \text{ nA}.$$

Generally, the threshold voltage of an organic light-emitting element is 2 to 3 V. When driving an organic light-emitting element to emit light with the smallest electric current necessary for producing an 8-bit gradation, the junction capacitance of the element needs to be charged before the element starts emitting light. The time required for charging the junction capacitance can be estimated by junction capacitance C×light emission threshold voltage Vt =minimum electric current Imin×time t.

Thus, time t=2.5 pF×2 to 3 V/8 to 12 nA

≅420 μs to 940 μs.

It takes so much time only for charging the junction capacitance. This simply means that an image display device with a pixel size of the VGA class cannot display any moving image.

Referring to FIG. 1, when the TFT (M3) becomes ON, the above Vref is applied to the gate electrode of the TFT (M2) and a voltage equal to Vref−Vos is applied to the corresponding terminal of the organic EL element. Therefore, if the light emission threshold voltage of the organic EL element is Vt, it is only necessary to charge a voltage equal to the difference of Vt−Vout.

Thus, with the circuit configuration of this embodiment, it is possible to precharge not only the gate voltage of the TFT (M2) but also the junction capacitance of the light-emitting element at the same time.

For example, if the junction capacitance is C and the electric current necessary for emission of light is I and the reference voltage is Vref, the time t that needs to be consumed until the start of light emission is calculated in a manner shown below.

$$t=(Vt-V\text{out})\times C/I=(Vt-Vref+Vos)\times C/I,$$

As described above, assume that the light emission current is 100 nA. If Vt−Vout is equal to 0.5 V and the capacitance C is equal to 2.5 pF, the time that needs to be consumed until the start of light emission is $$t=0.5\times 2.5 \text{ pF}/100 \text{ nA}=12.5\ \mu s.$$

With such a value, it is possible to realize the minimum time of 30 μs required for devices conforming to the VGA Standard.

As described above, according to the invention, it is possible not only to cancel the offset voltage due to the variances of the characteristics of the TFTs but also to precharge the junction capacitance in advance so that the time required to be consumed until the start of light emission of each element can be reduced by eliminating the time required for charging the junction capacitance.

Embodiment 2

Figure 3:
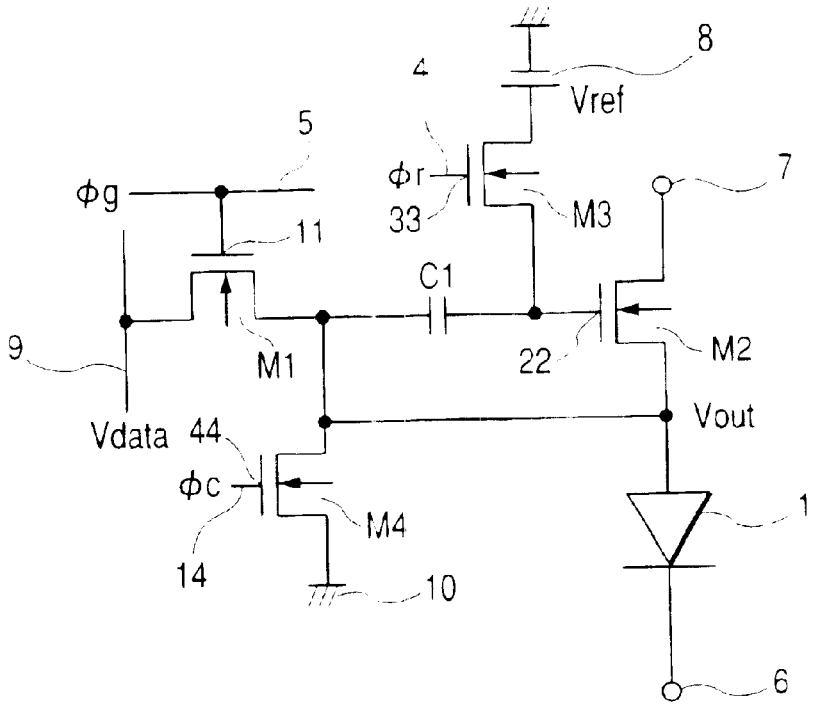
FIG. 3 is a circuit diagram of the second embodiment of drive circuit to be used in an active matrix type light-emitting element, the second embodiment having a configuration same as that of the first and further comprising a fourth circuit section including a fourth TFT (M4) and a power source.
Figure 4:
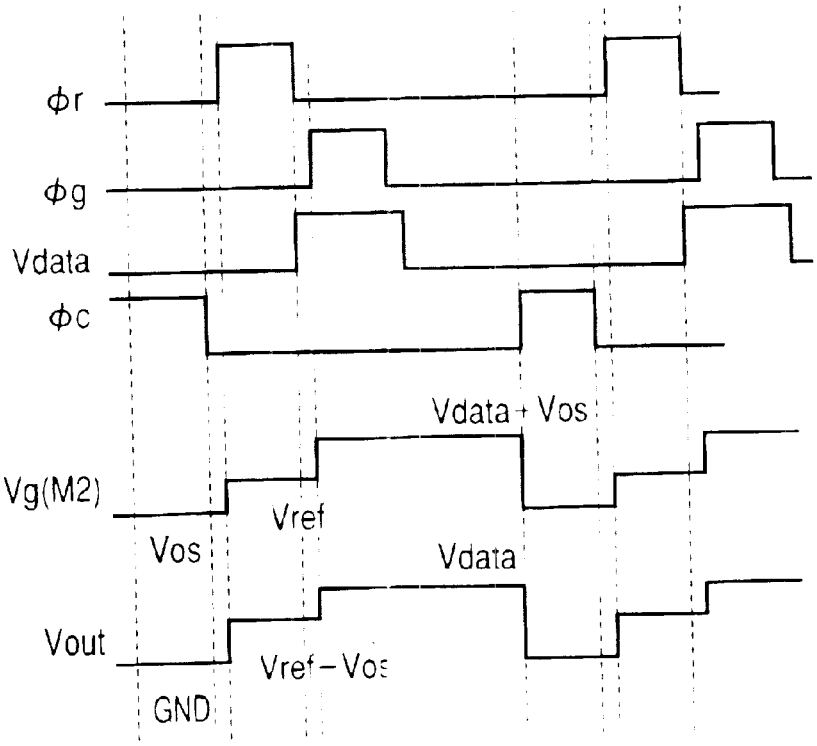
FIG. 4 is a timing chart to be used for the second embodiment of drive circuit.

FIG. 3 is a circuit diagram of the second embodiment of drive circuit to be used in an active matrix type light-emitting element array and FIG. 4 is a drive timing chart to be used for the second embodiment of drive circuit.

This embodiment of drive circuit is so designed as to be used in an active matrix type light-emitting element array comprising scan lines 5 and signal lines 9 arranged to form a matrix and unit pixels arranged near the respective crossings of the scan lines and the signal lines, each unit pixel including a plurality of TFTs (M1, M2, M3, M4) and a light-emitting element 1.

This embodiment employs an organic EL element for the light-emitting element 1. One of the electrodes of the light-emitting element 1 is connected to first power source 6. The drain electrode of the first TFT (M1) is connected to one of the electrodes of memory capacitance C1 and at the same time to the drain electrode of the second TFT (M2), the drain electrode of the fourth TFT (M4) and the other electrode of the light-emitting element 1.

The second TFT (M2) has its source electrode connected to second power source 7 and its gate electrode 22 connected to the other electrode of the memory capacitance C1 and the drain electrode of the third TFT (M3) and has its drain electrode connected to the other electrode of the light-emitting element and the aforementioned one electrode of the memory capacitance.

Additionally, the third TFT (M3) has its source electrode connected to reference power source 8 and its gate electrode 33 connected to first control signal line 4. The first TFT (M1) has its source electrode connected to picture data signal line 9 and its gate electrode 11 connected to the scan line 5. Furthermore, the fourth TFT (M4) has its source electrode connected to second reference power source (reset voltage) 10 (ground potential GND in this case) and its gate electrode 44 connected to second control signal line 14.

The basic concept of canceling the offset voltage of this embodiment is same as that of the first embodiment. However, this embodiment additionally comprises a fourth TFT (M4) having its drain electrode connected to one of the electrodes of the memory capacitance C1 and one of the electrodes of the light-emitting element 1. The source electrode of the TFT (M4) is connected to the second reference power source (reset voltage) 10, which shows GND. The TFT (M4) is made ON before the timing of precharging (turning ON the TFT (M3)). If the TFT (M4) is turned ON when the second reference power source (reset voltage) shows the ground potential, the memory capacitance C1 is grounded to discharge its electric load so as to make the potential difference between the opposite ends of the light-emitting element 1 equal to zero before transferring the next signal voltage Vdata and completely stop the emission of light. If an EL element is used for the light-emitting element, the element can be brought into an electrically relaxed state to effectively prolong the service life of the element for emission of light when the potential difference between the opposite ends of the light-emitting element is reset before another start of emission of light.

Note, however, that any voltage not higher than the light emission threshold voltage of the light-emitting element may be used to reset the element by stopping the emission of light of the element. While the GND potential is selected as reset voltage in this embodiment, the effect of stopping the emission of light can be realized by some other voltage that is not higher than the light emission threshold voltage of the light-emitting element. An effect of precharging the element can also be achieved when a voltage close to the light emission threshold voltage of the element is selected for the reset voltage because the junction capacitance of the element can also be charged.

While all the TFTs are Nch-TFTs in the above described embodiments, it may be needless to say that they may be replaced by Pch-TFTs to achieve the same effects. Note that the logic of the control electrode drive timing signal for each of the TFTs is inverted if Pch-TFTs are used.

Embodiment 3

Figure 5:
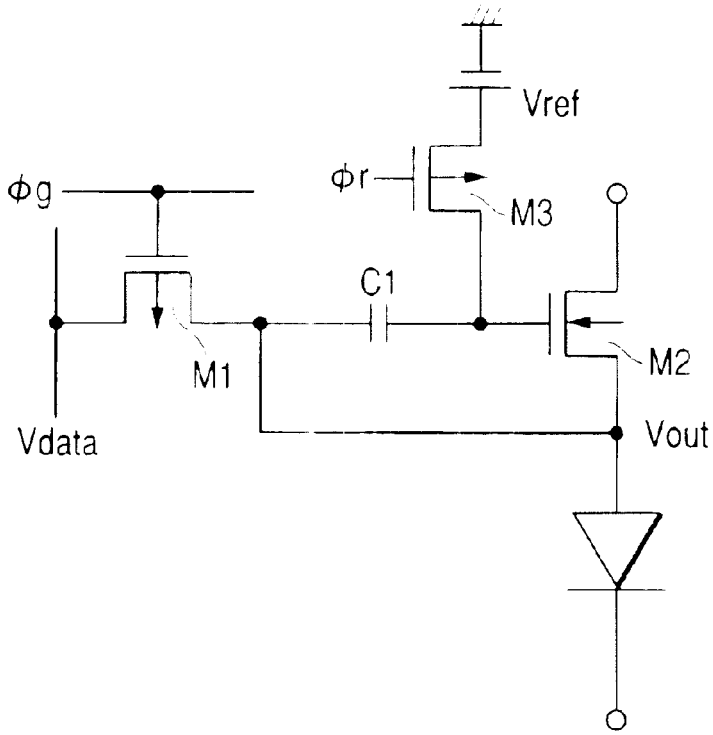
FIG. 5 is a circuit diagram of the third embodiment of drive circuit to be used in an active matrix type light-emitting element.
Figure 6:
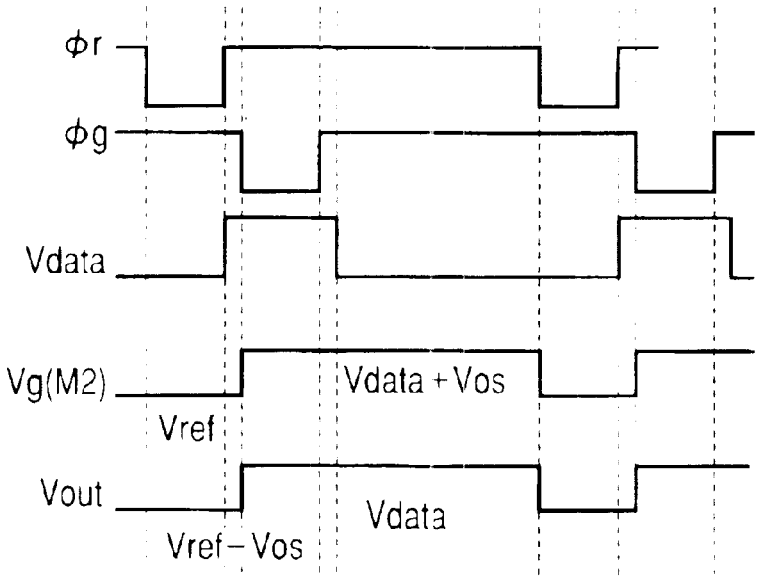
FIG. 6 is a timing chart to be used for the third embodiment of drive circuit.

FIG. 5 is a circuit diagram of the third embodiment of drive circuit to be used in an active matrix type light-emitting element and FIG. 6 is a drive timing chart to be used for the third embodiment of drive circuit.

While this embodiment has a configuration basically same as the first embodiment, the TFT (M2) that is used for a source follower circuit is made to show a polarity opposite to that of the remaining TFTs (M1, M3). Therefore, the polarity of the precharge control signal or and that of the scan line signal øg are inverted from those of FIG. 2. The TFT (M2) operates with a positive logic, whereas the TFTs (M1, M3) operate with a negative logic.

More specifically, since the M1 and M3 are turned ON at the low level of M2, signals Vref and Vdata to be used for a positive logic can be transferred reliably. As a result, the amplitude of the gate voltage of each of the M1 and M3 can be reduced when transferring Vref and Vdata. Thus, this embodiment of drive circuit can be downsized if compared with the first embodiment having a circuit configuration as shown in FIG. 1 and hence the power consumption rate of the entire current of this embodiment can also be reduced.

Embodiment 4

Figure 7:
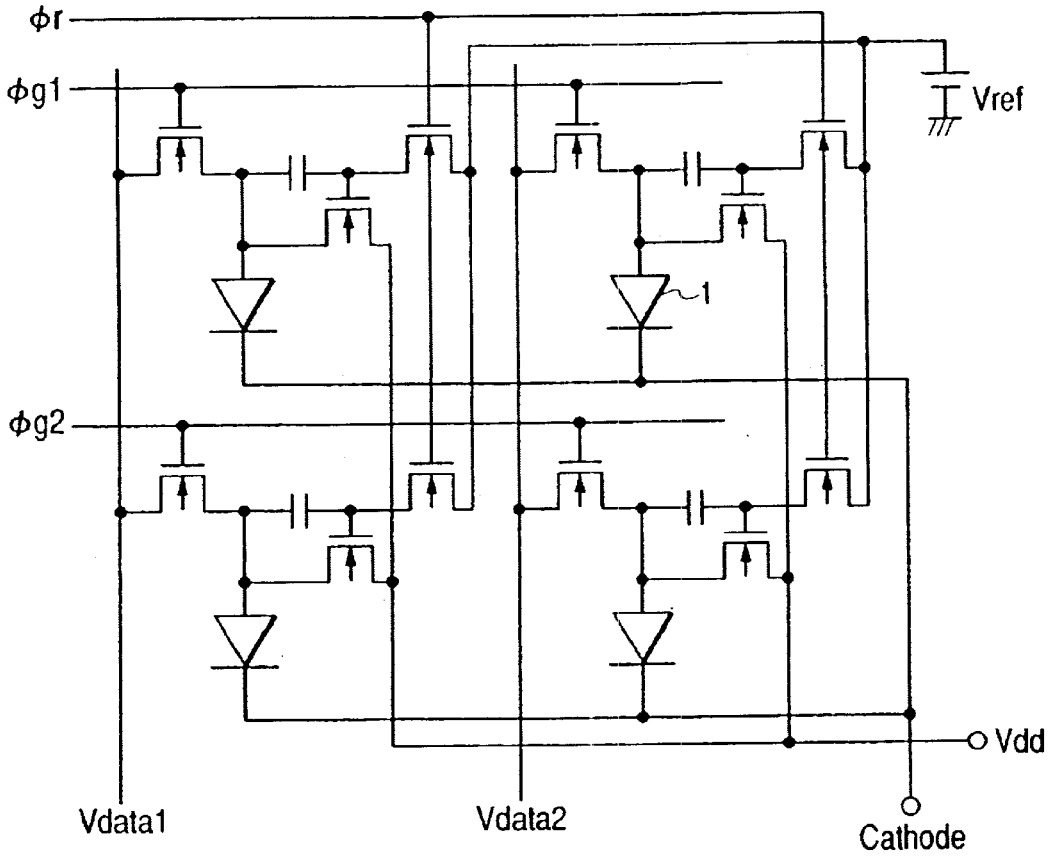
FIG. 7 is a circuit diagram of the fourth embodiment of the invention, which is an active matrix type light-emitting element.
Figure 8:
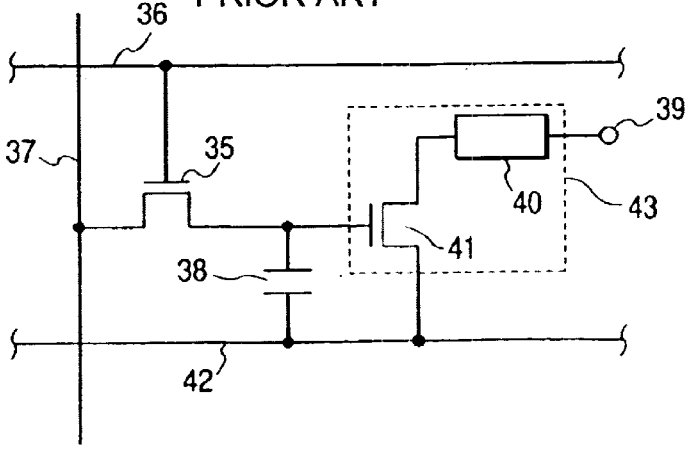
FIG. 8 PRIOR ART
FIG. 8 is a circuit diagram of known drive circuit to be used in an active matrix type light-emitting element.
Figure 9:
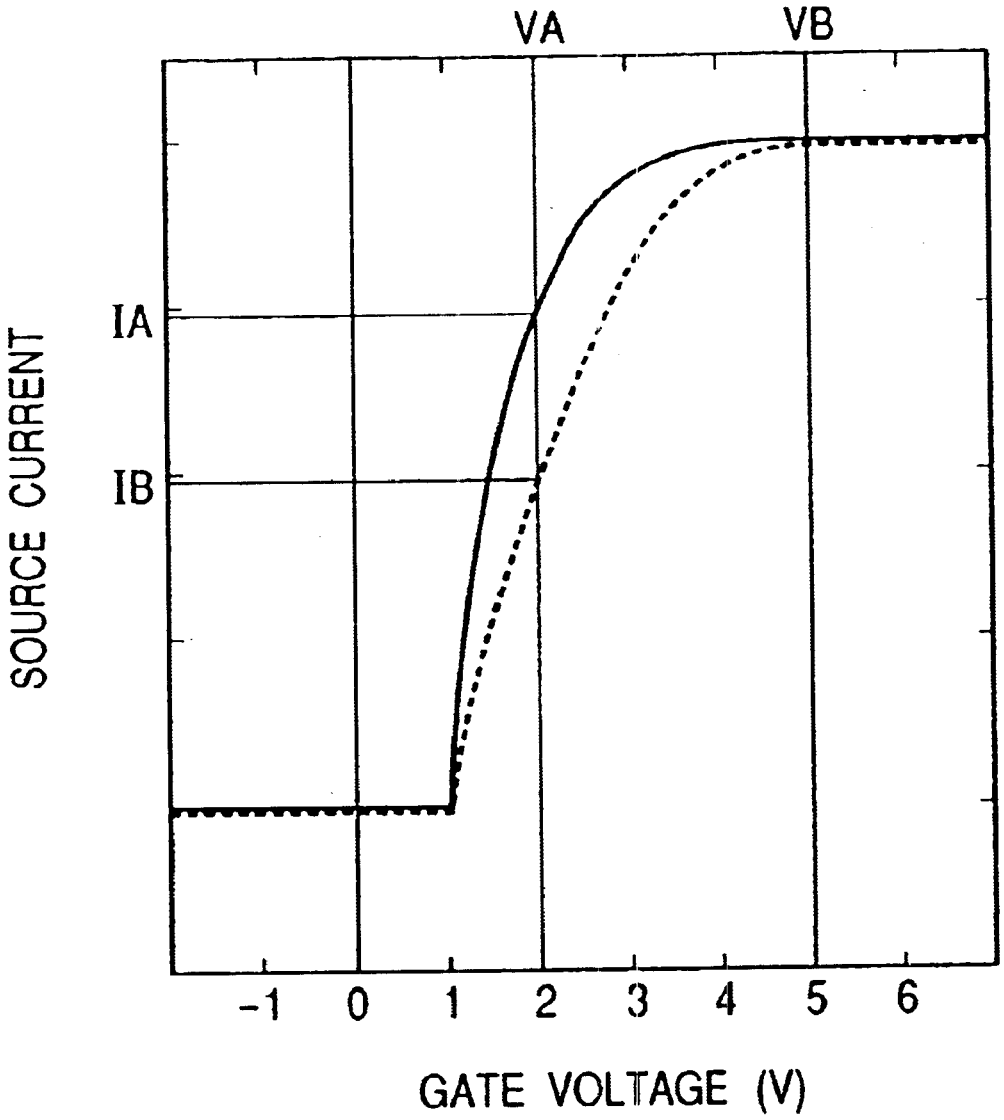
FIG. 9 PRIOR ART
FIG. 9 is a graph illustrating the gate voltage—source current characteristic (Id-Is characteristic) of transistors having a same threshold voltage Vth and different electric current characteristics.
Figure 10:
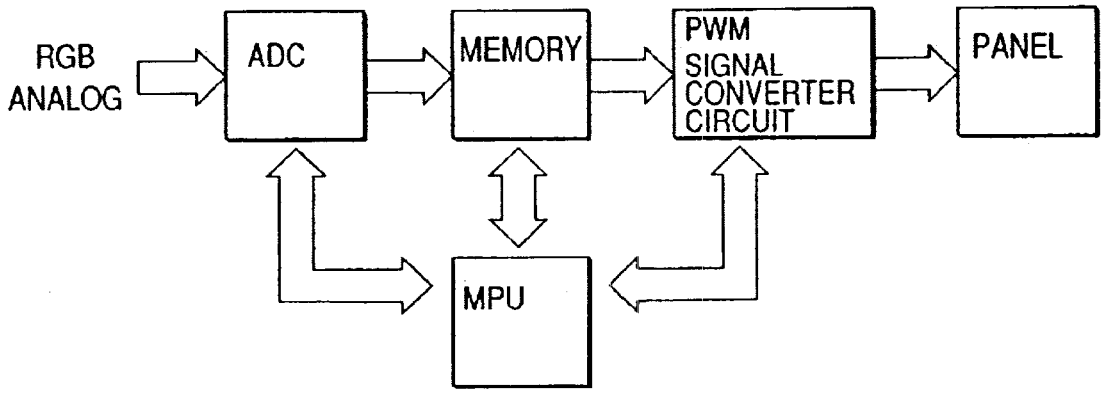
FIG. 10 PRIOR ART
FIG. 10 is a schematic block diagram of a known PWM drive system.
Figure 11:
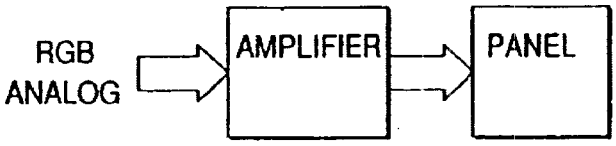
FIG. 11 PRIOR ART
FIG. 11 is a known analog drive system.

FIG. 7 is a circuit diagram of an active matrix type light-emitting element array realized by arranging drive circuits of the first embodiment in the form of matrix. This embodiment of display panel comprises drive circuits of the first embodiment and a plurality of pixel sections are also arranged in the form of matrix. Light-emitting elements 1 are arranged at the respective pixel sections. While FIG. 7 shows a 2×2 matrix circuit for the purpose of simplification, it may be clear that the number of rows and that of columns are not subject to any limitation.

Referring to FIG. 7, φg (φg1, φg2, . . . ) are sequentially selected at least on a row by row basis by the output of a scan circuit (not shown) typically comprising vertical shift registers. As rows are sequentially selected, picture data signals Vdata (Vdatal, Vdata2, . . . ) that represent the display brightness of the corresponding pixels are transferred from the respective signal lines. An electric current is made to flow through the organic EL light-emitting elements by the above described mechanism of driving the pixel circuits as a function of signal level.

Control pulse signal φr and reference voltage Vref are commonly supplied to all the pixels to drive them at the same time. Alternatively, control pulse signal φr may be supplied to each row independently, although an output circuit is required to select individual rows by controlling φr in such a case.

A matrix display device having a configuration as described above is adapted to display an image stably without being influenced by variances in the threshold voltage Vt of the TFTs of the device. Since it employs not the time gradation display system but the analog gradation display system, it does not require the use of a PWM modulation circuit or the like so that the entire drive system of the device can be simplified to provide a great advantage in terms of manufacturing cost.

Additionally, with the time gradation system, a field time period is divided into several sub-periods so that ON/OFF operations are required to be carried out within a short period of time. Then, the electric resistance of the matrix wiring is required to be minimized because the drive waveform is apt to delay if the electric resistance of the wiring is high. To the contrary, a wide choice is available to the selection of the material of the wires for a circuit designed with this system because the resistance of the wiring is not required to be extremely low and, at the same time, it is not necessary to use wires having a large thickness to a great advantage of the circuit from the manufacturing point of view. Therefore, both the manufacturing cost and the power consumption rate can be improved remarkably if compared with conventional circuits.

Furthermore, as pointed out earlier, the junction capacitance of the light-emitting element can be precharged in advance to remarkably improve the response speed of the light-emitting element in a low electric current light emission zone when the reference voltage Vref is so selected as to be not greater than the light emission threshold voltage of the light-emitting element. While not illustrated in the drawings, a display panel realized by arranging drive circuits of the second or third embodiment into the form of matrix provides effects and advantages similar to those described above by referring to the first embodiment.

While light-emitting elements are described mainly in terms of organic EL elements for the above embodiments, the present invention is by no means limited to organic EL elements and they are replaced by other light-emitting elements such as inorganic EL elements or LEDs without losing the advantages of the present invention. As for the polarities of the TFTs, it may be needless to say that they are not limited to those described for the above embodiments. The material of the TFTs is not limited to inorganic semiconductor such as silicon and may alternatively be made of any of the organic semiconductor that have been developed in recent years.

As described above in detail, according to the invention, it is now possible to provide a drive circuit of an active matrix type light-emitting element array that can cancel variances in the signal to be applied to the light-emitting elements so as to improve the response speed of the light-emitting elements when TFTs realized using polycrystal silicon and showing a characteristic that is subject to variance are employed and also an active matrix type display panel using such a drive circuit.

What is claimed is:

1. A drive circuit to be used in an active matrix type light-emitting element array comprising scan lines and signal lines arranged on a substrate to form a matrix and unit pixels formed near the respective crossings of the scan lines and the signal lines, each unit pixel including a light-emitting element and a plurality of thin film transistors each having a source electrode, a gate electrode and a drain electrode, said drive circuit comprising:

a first circuit section including a first thin film transistor (M1) having a gate electrode connected to a scan line, a source electrode connected to a signal line and a drain electrode;

a second circuit section including a light-emitting element having an electrode connected to a first power source and a second thin film transistor (M2) having a gate electrode, a source electrode connected to a second power source and a drain electrode connected to another electrode of the light-emitting element, hence said light-emitting element being connected in series to said second thin film transistor; and a third circuit section including a third thin film transistor (M3) having a gate electrode connected to a control signal line, a source electrode connected to a reference power source and a drain electrode connected to the gate electrode of said second thin film transistor;

the drain electrode of said first thin film transistor being connected to the gate electrode of said second thin film transistor by way of a memory capacitance (C1);

the drain electrodes of said first and second thin film transistors being commonly connected.

2. A circuit according to claim 1, wherein the voltage of said reference power source is higher than the threshold voltage of said second thin film transistor.

3. A circuit according to claim 1, wherein the voltage of said reference power source is lower than the light emission threshold voltage of said light-emitting element.

4. A circuit according to claim 1, further comprising:

a fourth circuit section including a fourth thin film transistor (M4) having a source electrode connected to a reset voltage and a drain electrode connected commonly to the input terminal of said light-emitting element.

5. A circuit according to claim 4, wherein the voltage of said reference power source is higher than the threshold voltage of said second thin film transistor.

6. A circuit according to claim 4, wherein the reset voltage is lower than the light emission threshold voltage of said light-emitting element.

7. A circuit according to claim 4, wherein the reset voltage is equal to the ground potential.

8. A circuit according to claim 4, wherein said circuit is provided with a function of forcibly terminating the light-emitting state of said light-emitting element by turning on said fourth transistor.

9. An active matrix type display device comprising a plurality of pixel sections arranged in the form of a matrix, said pixel sections respectively having drive circuits and light-emitting elements as defined in claim 1.

* * * * *

UNITED STATES PATENT AND TRADEMARK OFFICE

CERTIFICATE OF CORRECTION

PATENT NO. : 6,777,888 B2
DATED : August 17, 2004
INVENTOR(S) : Kondo

It is certified that error appears in the above-identified patent and that said Letters Patent is hereby corrected as shown below:

Title page,
Item [57], ABSTRACT,
Line 10, “s” should read -- is --.

Column 1,
Line 39, “drove” should read -- drive --.

Column 9,
Line 55, “or” should read -- ør --.

Signed and Sealed this

Seventh Day of February, 2006

JON W. DUDAS
*Director of the United States Patent and Trademark Office*